United States Patent [19]

Weston

[11] 4,193,510

[45] Mar. 18, 1980

[54] LIQUID STORAGE TANK

[75] Inventor: Sidney Weston, Sedgley, England

[73] Assignee: Northern Engineering Industries Limited, Gateshead, England

[21] Appl. No.: 858,490

[22] Filed: Dec. 8, 1977

[30] Foreign Application Priority Data

Jan. 11, 1977 [GB] United Kingdom ..... 986/77

[51] Int. Cl.[2] ..... B65D 7/02; G65D 7/00; B65D 7/42

[52] U.S. Cl. ..... 220/5 A; 220/83; 220/81 R; 220/4 F

[58] Field of Search ..... 220/5 A, 5 R, 4 R, 4 F, 220/1 B, 72, 83, 81 R, 84; 52/309.1, 474, 475, 578, 580, 581; D25/82, 92, 95

[56] References Cited

U.S. PATENT DOCUMENTS

| | | | |
|---|---|---|---|
| 2,634,017 | 4/1953 | Moyer | 220/81 R X |
| 2,971,667 | 2/1961 | Benson et al. | 220/5 A X |
| 3,064,770 | 11/1962 | Andrews | 220/5 A X |
| 3,215,301 | 11/1965 | Armstrong | 220/5 R |
| 3,395,824 | 8/1968 | Gerhard | 220/5 A |
| 4,050,605 | 9/1977 | Wakana et al. | 220/83 X |

*Primary Examiner*—Steven M. Pollard

[57] ABSTRACT

A liquid storage tank made of panels each of which is made typically of glass reinforced plastic material and is generally rectangular and has integral flanges on all four sides. Each corner is relieved. The wall of the panel has at least one stiffening formation integral therewith and typically of dished circular configuration.

Auxiliary members are used to complete the tank and occupy positions at the corners of the panels.

10 Claims, 14 Drawing Figures

W
50
58
52
58
62
66
64
B
54
A
XII
XII
66
64
58
58
W 58
50
54
58
58
58

58
58
64
66
62
56
58
58

Y 58
62
56
58
58
Z
Z
58
Y

LIQUID STORAGE TANK

BACKGROUND OF THE INVENTION

Panels (usually square) of pressed steel have been long used for making water storage tanks, the earliest known patent being the British patent having the specification No. 22900 of 1901 in the name of George Herbert Lloyd.

Very little change in the manufacture of such panels and tanks has occurred since.

Such panels are not capable of being used for making any structure other than tanks. Furthermore, such panels are made with accurately square corners and are fitted together without auxiliary members to make a tank. Several separate manufacturing stages are necessary to make such known panels including pressing hot steel blanks in a press and machining or grinding the edges and corners.

Improved tanks can be made according to the invention which especially finds realisation where modern materials such as reinforced plastic material is used in the manufacture of the panels.

The panels are superior both mechanically and aesthetically; and so are tanks made from them.

The panels can be made by a one-step method such as hot press moulding.

A theoretical proposal, not put into practice, is contained in British patent specification No. 1390176.

That proposal is for panels made by hand laying-up of glass-reinforced material. Stiffening of the panels is proposed by layer overlaps formed during laying up.

Such panels are not relieved at the corners and could not be made by moulding techniques because the sharp corners would not be correctly formed during the moulding process. The moulding process requires flow of material during moulding but adequate flow cannot occur at sharp corners of the kind shown in British specification No. 1390176.

Furthermore, the tank proposed in British Pat. No. 1390176 has no bracing to reinforce the tank walls and its walls are apparently liable to buckle under pressure from contained water.

It is in fact not possible to construct a tank in which forces due to pressure of contained liquid are sustained by the walls entirely free of bracing because the forces are too great.

A further theoretical proposal is given in British patent specification No. 1174893 in which tank panels are proposed to be made by extrusion. Each panel is to have an inner-facing layer of thermoplastic material bonded to the panel surface and the layers of adjacent panels being bonded at their edges to one another to form a continuous sealing layer within the tank.

Such a proposal is extremely impractical and would involve prohibitive costs of manufacturing of panels and erection of tanks.

The prior proposals have not led to panels or tanks being made and put into effective use.

Tanks according to the present invention have been made by the assignee of the present inventor. Said assignee is a principal manufacturer and exporter of pressed steel tank panels and is about to market tanks made according to the invention.

BRIEF SUMMARY OF THE INVENTION

An object of the invention is to provide a liquid storage tank made of moulded panels of reinforced synthetic plastic material.

The invention particularly enables modern factory techniques to be used to make panels of reinforced plastic material. Such panels can be used to construct tanks with greater ease than conventional panels.

A liquid storage tank having a floor and walls each made up of rectangular moulded panels of reinforced synthetic plastic material each said panel comprising a wall the periphery of the panel at the corner of the wall being relieved, the wall having at the periphery thereof a flange integral therewith extending away therefrom and the wall having at least one stiffening formation integral therewith, said panels in each said wall being secured together by first securement means engaging adjacent flanges of said panels, said tank further comprising auxiliary members each occupying a space defined by adjacent corners of said panels, each said auxiliary member having formation means restricting relative displacement of respective flanges of adjacent panels transversely of said adjacent panels, at least certain of said auxiliary members each having integral lug means positioned within said tank, said tank further comprising bracing means positioned wholly within said tank secured within said tank by second securement means to said lug means of said certain auxiliary members, and said tank further comprising seal element means held compressed by said first securement means in sealing relationshipwith said adjacent panels between adjacent flanges thereof and held compressed between said auxiliary members and respective surrounding panels in sealing relationship therewith by said first securement means.

Preferably, the relieved corners of the wall are such that the periphery at each corner is 45° to the adjacent side periphery of the wall.

The panel is usually a square panel, but oblong panels are also feasible.

Preferably, the or each stiffening formation is a dished, preferably circular, portion. The stiffening formation may protrude in the same direction as the flange extends away from the wall; and in that case there is an advantage for certain purposes if the formation protrudes no further than the flange. The stiffening formation may, however, protrude in the opposite direction to that on which the flange extends away from the wall.

The stiffening formation may be pyramidal, for example of four-sided type. Alternatively, the formation, or each formation, may be a rib; or the formation may be of cruciform shape; or the formation may be of star or flower shape.

The panel is preferably moulded and made of glass-reinforced synthetic plastic material, generally known as "GRP." A particularly suitable material for example is one selected from the range of polyester sheet moulding compounds available from British Industrial Plastics Limited of Warley, West Midlands, with glass reinforcement.

The flange may have holes to receive bolts for securing flanges together and whilst this is the preferred way of joining flanges other methods are feasible and may not necessitate holes in the flanges; for example clamps may be used to join flanges.

BRIEF DESCRIPTION OF THE DRAWINGS

Panels, auxiliary members, tanks and methods of making them will now be described by way of example to illustrate the invention with reference to the accompanying drawings in which.

Figure 1:
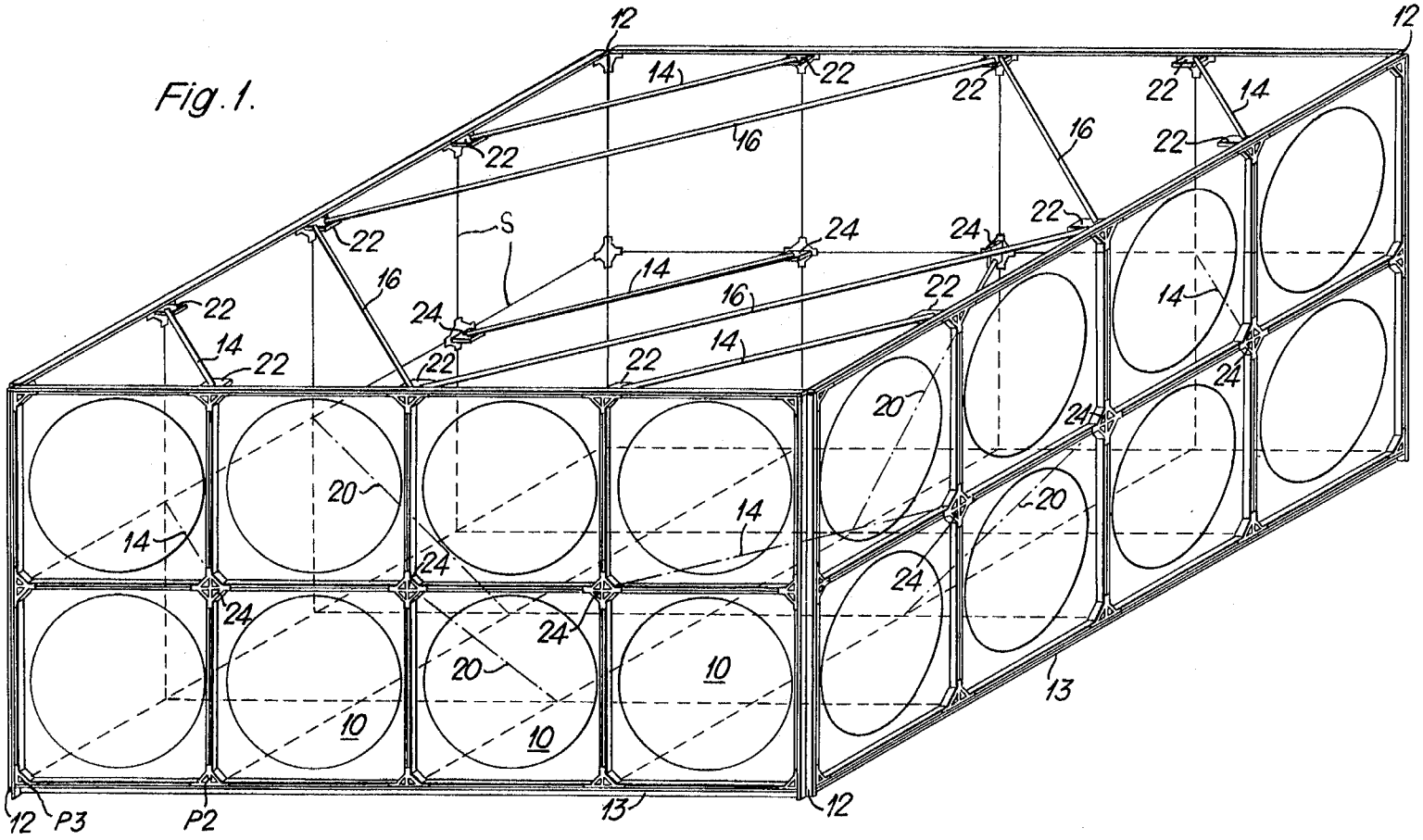
FIG. 1 is a schematic three-dimensional view of a water storage tank.

The tank shown in FIG. 1 is made up of square panels 10 typically of 1 meter side length.

The upright corners of the tank comprise elongate members 12 being lengths of edge angles to which the adjacent flanges are secured. The horizontal corners comprise members 13 of edge angles.

Internal strengthening and bracing is provided by lengths of edge angle 14, 16, 20 which are secured to auxiliary member 50 described below.

The panels 10 shown in FIG. 1 are shown in detail in FIGS. 2 to 8.

Figure 2:
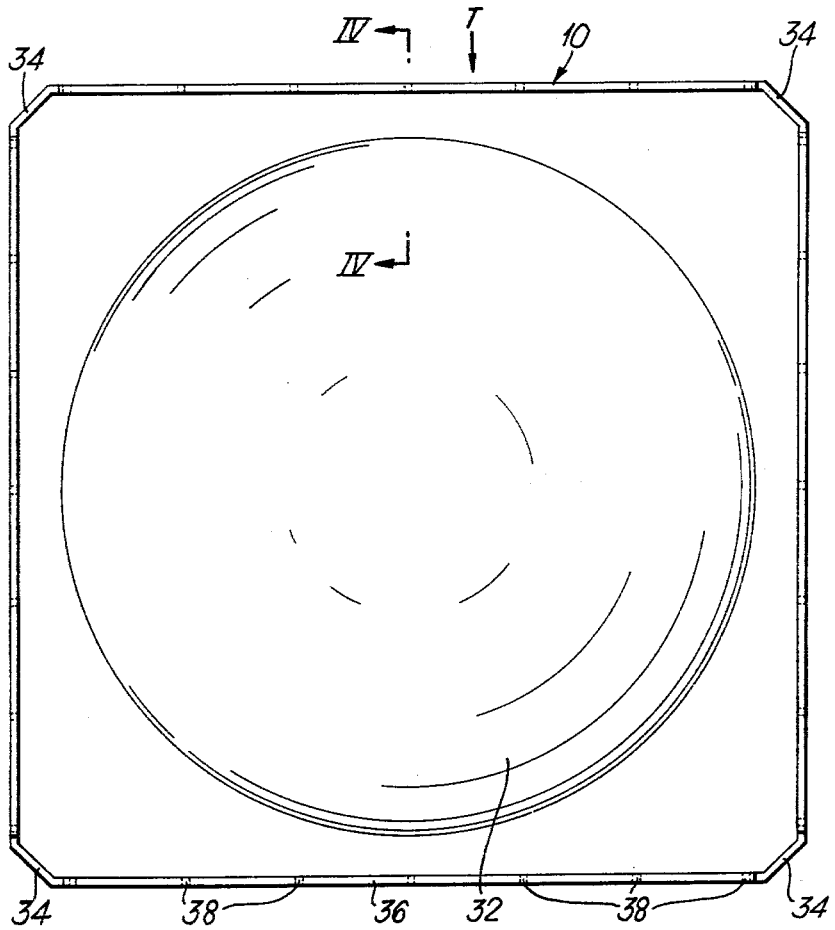
FIG. 2 is a plan of a first embodiment of panel.
Figure 3:
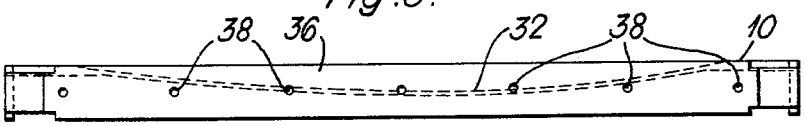
FIG. 3 is a side-elevation of the panel shown in FIG. 2 as seen in the direction of the arrow 'T'.
Figure 4:
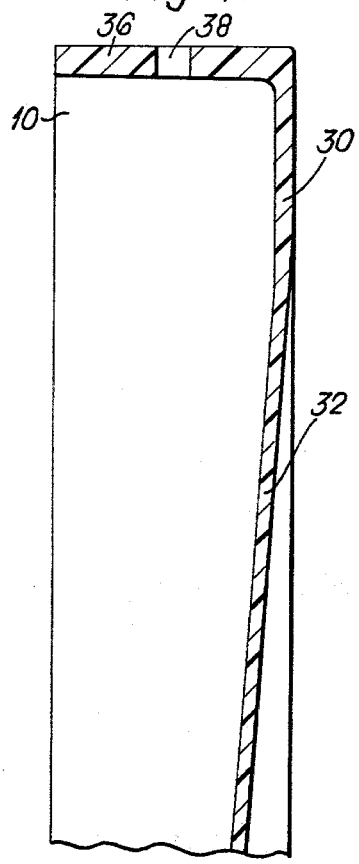
FIG. 4 is a section on the line IV—IV in FIG. 2.
Figure 5:
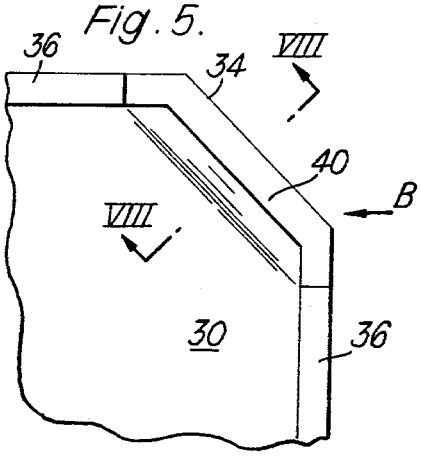
FIG. 5 is a corner detail view of the panel shown in FIG. 2.

Each is moulded from GRP and comprises a partly flat wall 30 the central portion 32 of which is dished (being convex towards the viewer in FIG. 2).

The diameter of the portion 32 is 870 millimeters and at the centre the portion is 50 mm proud of the general plane of the flat part of the wall 30, having a radius of curvature at its concave surface of 1917 mm.

The periphery of the panel 10 is relieved at each corner, the periphery 34 there being at 45°to the adjacent side periphery.

The panel 10 has integral therewith a flange 36 which extends away from the wall 30 at right-angles thereto (towards the view in Flange 2). The flange 36 has holes 38 to receive securing bolts (not shown), the holes being equally pitched at each side.

The flange extends 80 mm from the remote face of the panel (i.e. from the face remote from the view in FIG. 2). Thus, the dished convex portion 32 protrudes less than the flange 36 from the general plane of the panel wall 30. This is useful where the panels are required to be laid on a surface (e.g. to form the base of a tank such as is shown in FIG. 1). The load on each panel is thus borne by the flange edge rather than by the apex of the dished portion 32 where the flanges are downwardly extending.

Of course, the panels 10 may be laid on the surface 'other way up' so that the wall 30 engages the surface and the dished portions 32 and the flanges 36 extend upwardly.

The tank shown in FIG. 1 may be constructed with all the dished portions and flanges facing inwardly instead of outwardly.

The flange 36 has four shallow slots 40 each extending over the whole of the respective corner position of the flange and extending slightly and equally over each of the two respective adjacent side portions of the flange (see FIG. 5 to 8).

The panel 10 has four rebates 42 (see FIG. 5 to 8) generally opposite the respective slots 40.

Figure 6:
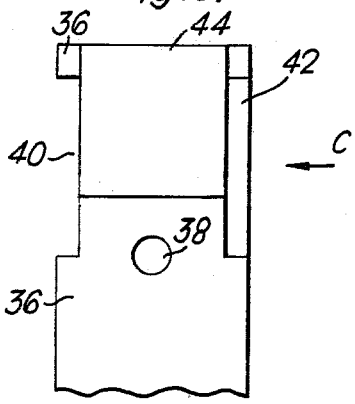
FIG. 6 is a corner detail view as seen in the direction of the arrow 'B' in FIG. 5.
Figure 8:
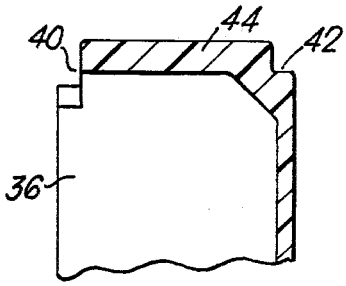
FIG. 8 is a section on the line VIII—VIII in FIG. 5.
Figure 7:
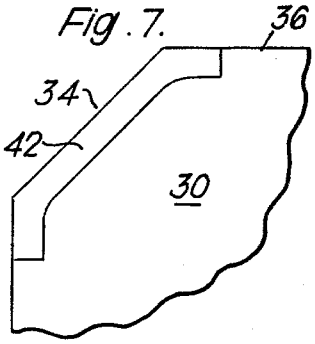
FIG. 7 is a corner detail view as seen in the direction of the arrow 'C' in FIG. 6.

The corner flange portion 44 between the slot 40 and the rebate 42 has a dimension of 65 mm at 'X' as shown in FIGS. 6 and 8.

When panels 10 as shown in FIGS. 2 to 8 are assembled to make structures such as tanks as indicated generally in FIG. 1 or in similar manner the presence of the relieved corner peripheral portions 34 on each panel gives rise to spaces where panel corners come together.

The invention provides auxiliary members 50 which will now be described and which can be assembled with the panels 10 in such spaces to complete the structure.

The principal type of auxiliary member is shown in FIGS. 9 to 12; further types will be described but are not illustrated in detail. They are shown in FIG. 1 as half-portions or quarter portions of the principal type of member.

The principal auxiliary member 50 is moulded from glass-filled nylon of a water-resistant grade, as are the other types.

The member 50 has a block shaped core 52 with integral generally square flanges 54, 56. The flanges 54, 56 have extensions 58 at their corners. The flanges 54, 56 are spaced apart 65 mm so as to be capable of receiving the corner portions 44 of a panel 10 in close fitting relationship.

The member 50 has an integral lug 62 housing four holes 64 each passing through respective upstanding bosses 66 at each face of the lug 62.

Figure 12:
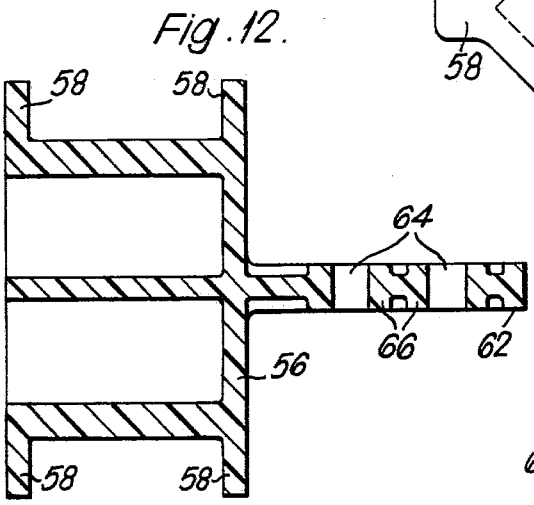
FIG. 12 is a section on the line XII—XII in FIG. 9.
Figure 11:
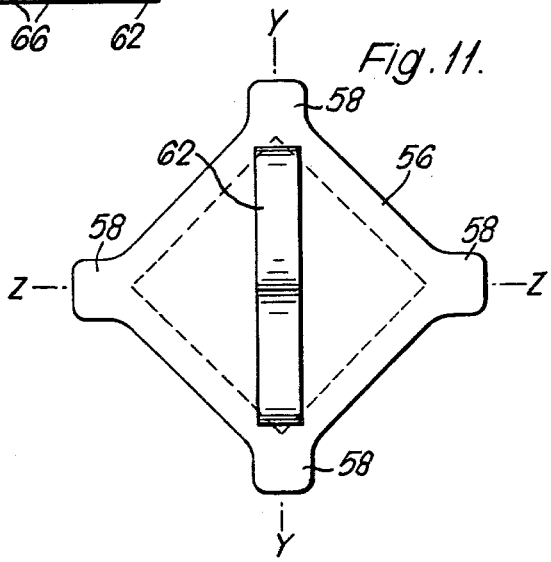

A second type of auxiliary member is made by cutting a member 50 into two similar parts at the plane Y-Y in FIG. 12, or by cutting a member 50 into two similar parts at the plane ZZ in FIG. 12.

Figure 9:
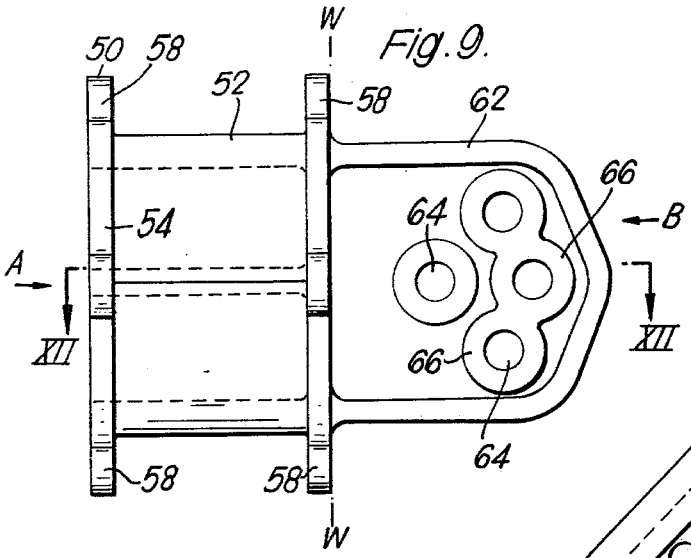
FIG. 9 is a side elevation of an auxiliary member.
Figure 10:
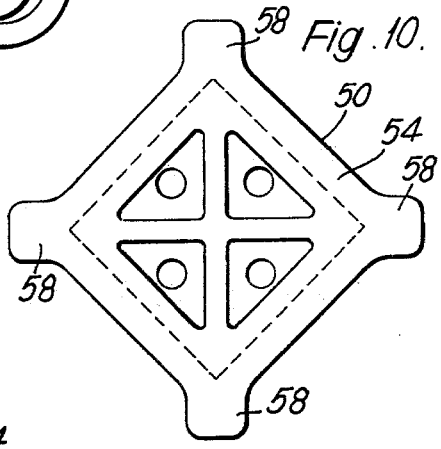
FIGS. 10 and 11 are respectively views as seen in the direction of the arrows 'A' and 'B' in FIG. 9.

A third type of auxiliary member is made by cutting a second-type member into two similar parts at the plane Z—Z or Y—Y respectively in FIG. 12 and by removing the lug 62 at the plane W—W in FIG. 9.

The auxiliary members of the first and second type may be modified by removing the lug 62 by cutting at the plane W—W in FIG. 9 for use as plug-type members where no lug is required (see items P2 and P3 in FIG. 1). In making a structure such as a water-storage tank similar to that shown in FIG. 1 it is necessary to make the joints between panels and between panels and/or auxiliary members and edge angles water-tight. This is done by wrapping round the outside of each flange a length or two or more lengths side-by-side of adhesive water-proof tape before the panel is positioned. When the nuts and bolts are tightened the tape is compressed in place to give a very good water-tight seal, as indicated at S in FIG. 1. Also, each auxiliary member may have tape similarly wrapped around its central block; and each edge angle may have a length or lengths placed along its flanges before assembly. It may be convenient to omit the tape from the auxiliary members and edge angles, however. The tape used may be that sold under the name 'Inseal' by Industrial Sealants Limited, Borehamwood, Hertfordshire, England.

The panels are held together by bolts passed through the holes 38 and through holes in the flanges of the edge angles where required and secured by nuts with washers. The bolts may be mainly type M10 Sheradized to fit 12 mm holes with some type M12 similar to fit 14 mm holes as required. Stainless steel nuts bolts and washers may be used if preferred.

The assembly is easily made and personnel erecting tanks or other structures have no difficulty lifting panels up into place. Each panel weighs some 15 Kgs (33 lbs).

The panel 10 is stiffened by the dished formation at 32. Different stiffening formations may be used as mentioned at the introduction of this specification, or several circular or other formation may be formed in the panel. However, the formation shown facilitates moulding of the panel and reduces the risk of stress concentration in the panel.

An alternative form of panel may have the stiffening formation or each formation protruding in the opposite direction to the flange (see FIGS. 13 and 14); or the formation or each of them may be shaped so as to protrude beyond the flange.

In yet another modification the stiffening formation or each formation may protrude at both faces of the panel; or some formations may protrude at one face and others at the other face and the degree of protrusion may be less than equal to or greater than the degree of protrusion of the flange in any or all of the cases mentioned above.

In a tank, for example, the panels may be arranged with the stiffening formations protruding all inwardly; or all outwardly; or some inwardly and some outwardly.

A tank need not be made up of only one pattern of panel; and in some cases square and oblong panels may be used in the same structure; or panels of different sizes but similar shape.

As an alternative to securing the panels by nuts and bolts, clamps may be used engaging the flanges, or other fasteners may be used whether extending through holes or otherwise.

Figure 13:
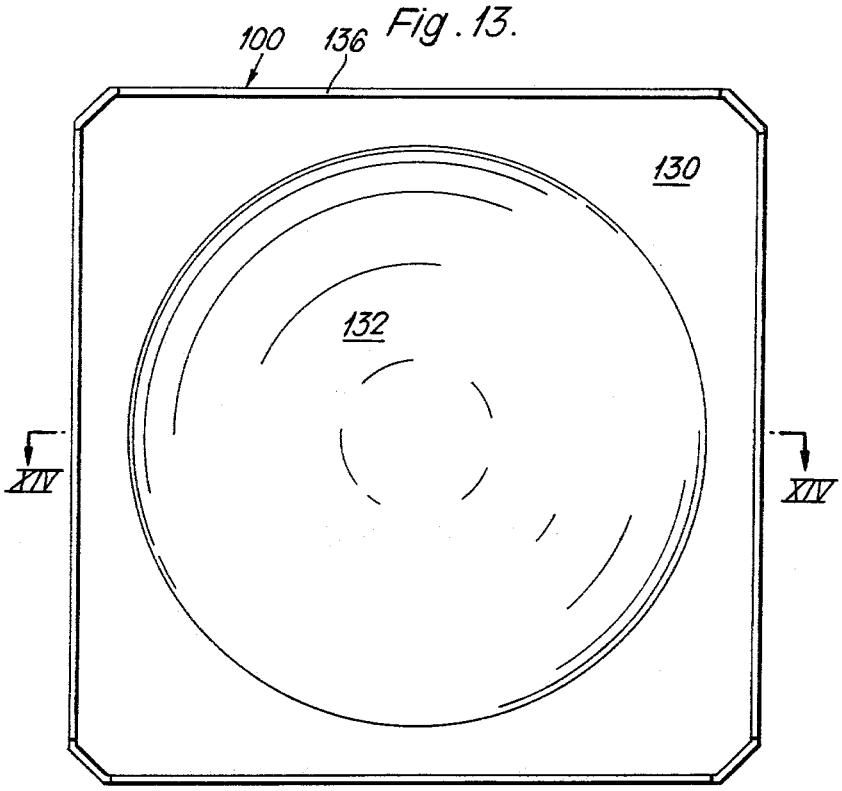
FIGS. 13 and 14 respectively are a plan and a section on the line XIV—XIV in FIG. 13 showing a second embodiment of panel.
Figure 14:
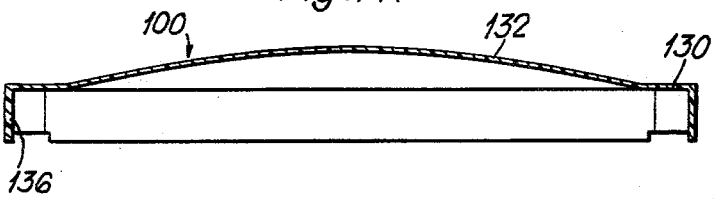

FIGS. 13 and 14 show a second embodiment of panel 100 in which the partly flat wall 130 has a central circular portion 132 which is dished oppositely to the panel 10 so that the convex side of the portion 132 protrudes oppositely to the flange 136. The panel 100 is used in a manner exactly analogous to the panel 10 to make up tanks or for other purposes.

The panels 100 ade made of GRP and have corner details similar to the panels 10.

The panels may be made using other reinforcing material (for example using carbon fibre reinforcing material) and using other kinds of polyester or other resin material, or using other synthetic plastic material.

The preferred method of making the panels is by hot press moulding, which is a known technique and need not be described here. The shape of panel described above is ideally suited to moulding while at the same time giving excellent mechanical and aesthetic properties in the finished panel and in structures made from the panels. The panels may readily be coloured as desired by colouring the material from which they are moulded.

The design of the panel is such as to enable the advantages of modern factory moulding techniques to be realised to the full. In particular, the panel has accurately shaped and dimensioned surfaces ensuring correct and accurate fitting together of panels, thus simplying and speeding erection of tanks and other structures. Such panels can be readily produced in large numbers all of required standard.

In the case of tanks such accuracy and simplicity also leads to a simple and advantageous sealing technique using the simplest of seal elements a mere adhesive tape compressed between panels or between panel and auxiliary or other member. Such technique is vastly superior to the very difficult situation arising where steel panels are used which requires very skilled assembly and sealing operations for success.

It is to be noted that prior theoretical proposals referred to above using plastic panels for tank construction are wholly silent on the matter of sealing or postulate impractical bonding of panels one to another without the use of a seal element.

The present invention achieves a unique simplicity of construction which is nowhere taught by any prior proposals nor achieved in any practical structure.

In a further modification, the bracing items 14, 16, 20 may be dispensed with inside the tank and bracing provided instead outside the tank secured to cleats 50 having their lugs 62 facing outwardly.

Tanks constructed according to the invention have bracing loads applied to the integral flanges 36 of the panels. No holes pass through the panel wall 30 so that no bolt or other securements apply load to the wall and no leakage through such holes can arise. All bracing loads pass through the auxiliary members 50 and relative panel movement transversely to the plane of the wall or floor is prevented by the inter-engagement of auxiliary members and flanges 36 at the extensions 58.

What I claim is:

1. A liquid storage tank having a floor and walls each made up of rectangular moulded panels of reinforced synthetic plastic material, each said panel comprising a wall the periphery of the panel at the corner of the wall being relieved, the wall having at the periphery thereof a flange integral therewith extending away therefrom and the wall having at least one stiffening formation integral therewith, said panels in each said wall and in said floor being secured together by first securement means engaging adjacent flanges of said panels, said tank further comprising auxiliary members each occupying a space defined by adjacent corners of said panels, each said auxiliary member having formation means restricting relative displacement of respective flanges of adjacent panels transversely of said adjacent panels, at least certain of said auxiliary members each having integral lug means positioned within said tank, said tank further comprising bracing means positioned wholly within said tank secured within said tank by second securement means to said lug means of said certain auxiliary members, and said tank further comprising seal element means held compressed by said first securement means in sealing relationship with said adjacent panels between adjacent flanges thereof and held compressed between said auxiliary members and respective surrounding panels in sealing relationship therewith by said first securement means.

2. A liquid storage tank according to claim 1, in which said formation means comprise spaced formation between which said respective flanges of said adjacent panels are located.

3. A liquid storage tank according to claim 1, in which each said integral lug means lies in a horizontal plane coincident with or close to the horizontal plane at which the respective panels meet.

4. A liquid storage tank having a floor and walls each made up of square moulded panels of glass reinforced synthetic plastic material, each said panel comprising a wall the periphery of the panel at the corner of the wall being relieved, the wall having at the periphery thereof a flange integral therewith extending away therefrom and the wall having a planar part adjacent said flange but having an integral central circular stiffening formation which is curved, said panels in each said wall and in said floor being secured together by first securement means engaging adjacent flanges of said panels, said tank further comprising auxiliary members each occupying a space defined by adjacent corners of said panels, each said auxiliary member having spaced formations between which the respective flanges of adjacent panels are located, at least certain of said auxiliary members each having integral lug means positioned within said tank, said tank further comprising bracing means positioned wholly within said tank secured within said tank by second securement means to said lug means of said certain auxiliary members, and said tank further comprising seal element means held compressed by said first securement means in sealing relationship with said adjacent panels between adjacent flanges thereof and held compressed between said auxiliary members and respective surrounding panels in sealing relationship therewith by said first securement means.

5. A liquid storage tank according to claim 4, in which at each of said relieved corners of each said panel said flange extends at 45° to adjacent side portions of said periphery and in which each said auxiliary member where four co-planar panels embrace the same is a first-type member and has four wall surfaces in square relationship, said seal element means being held compressed in said sealing relationship between said four wall surfaces and respective relieved corners of respective ones of said four co-planar panels.

6. A liquid storage tank according to claim 4, in which at each of said relieved corners of each said panel said flange extends at 45° to adjacent side portions of said periphery and in which the respective auxiliary member where only two co-planar panels embrace the same is a second-type member which has two wall surfaces in square relationship and a third wall surface in the relationship of a hypotenuse thereto, said seal element means being held compressed in said sealing relationship between said two wall surfaces and respective relieved corners of respective ones of said two co-planar panels and between said third wall surface and an elongate member making up said wall or said floor of said tank.

7. A liquid storage tank according to claim 4, in which at each of said relieved corners of each said panel said flange extends at 45° to adjacent side portions of said periphery and in which where three said panels approach a corner of said tank, there are three third-type auxiliary members, each having two wall surfaces in square relationship and a third wall surface in hypotenuse relationship thereto, and in which the respective seal element means is held compressed in said sealing relationship between said two wall surfaces and respective elongate members making up said walls and between said third wall surface and the respective relieved corner of the respective panel.

8. A liquid storage tank according to claim 4, in which said flange and said stiffening formation of each said panel both extend outwardly away from the interior of said tank but in which said stiffening formation lies within the volume defined by said planar part of said wall and by said flange.

9. A liquid storage tank according to claim 4, in which said flange of each said panel extends outwardly away from the interior of said tank and in which said stiffening formation of each said panel extends inwardly towards the interior of said tank.

10. A liquid storage tank according to claim 4, in which said curved stiffening formation is convex in the same direction as said flange extends relative to said planar part of said wall.

* * * * *